US010651524B2

(12) United States Patent
Churkin et al.

(10) Patent No.: US 10,651,524 B2
(45) Date of Patent: May 12, 2020

(54) PLANAR ORTHOMODE TRANSDUCER

(71) Applicant: Infinet LLC, Moscow (RU)

(72) Inventors: Sergey Sergeevich Churkin, Nizhny Novgorod (RU); Aleksey Andreevich Artemenko, Nizhny Novgorod (RU); Andrey Viktorovich Mozharovskiy, Nizhny Novgorod (RU); Roman Olegovich Maslennikov, Nizhny Novgorod (RU)

(73) Assignee: Infinet LLC, Moscow (RU)

( * ) Notice: Subject to any disclaimer, the term of this patent is extended or adjusted under 35 U.S.C. 154(b) by 0 days.

(21) Appl. No.: 16/221,821

(22) Filed: Dec. 17, 2018

(65) Prior Publication Data

US 2019/0190107 A1 Jun. 20, 2019

(30) Foreign Application Priority Data

Dec. 15, 2017 (RU) ..... 2017144118

(51) Int. Cl.
*H01P 1/161* (2006.01)
*H01P 1/213* (2006.01)
*H01P 5/02* (2006.01)

(52) U.S. Cl.
CPC ..... *H01P 1/161* (2013.01); *H01P 1/213* (2013.01); *H01P 5/024* (2013.01)

(58) Field of Classification Search
CPC ..... H01P 1/161; H01P 1/213; H01P 5/024
USPC ..... 333/137
See application file for complete search history.

(56) References Cited

U.S. PATENT DOCUMENTS 6,087,908 A 7/2000 Haller et al.
2015/0380824 A1* 12/2015 Tayfeh Aligodarz ..... H01Q 15/0066 343/785

FOREIGN PATENT DOCUMENTS

| | | | |
|---|---|---|---|
| CN | 103985924 A | | 8/2014 |
| CN | 104752541 A | | 7/2015 |
| CN | 107394395 A | * | 11/2017 |
| JP | H08242101 A | | 9/1996 |
| JP | H11308004 A | | 11/1999 |
| RU | 2461921 C1 | | 9/2012 |

* cited by examiner

*Primary Examiner* — Robert J Pascal
*Assistant Examiner* — Kimberly E Glenn
(74) *Attorney, Agent, or Firm* — Fox Rothschild LLP

(57) ABSTRACT

A planar orthomode transducer comprises a substrate integrated resonator, two substrate integrated waveguides connected to the substrate integrated resonator, a dual polarized metal waveguide and a printed circuit board where the substrate integrated resonator and the substrate integrated waveguides are provided, wherein the substrate integrated resonator further comprises a slot aperture in one of metallization layers, and the dual polarized metal waveguide is mounted on a surface of the printed circuit board in an area of the slot aperture of the substrate integrated resonator, wherein the substrate integrated resonator is a nonfundamental orthogonal mode resonator.
This enables widening of frequency band of the planar orthomode transducer, reducing of insertion losses, rise of the polarization diversity and providing for a standard dual polarized output waveguide serving for connecting the device with an antenna of various types.

17 Claims, 8 Drawing Sheets

PLANAR ORTHOMODE TRANSDUCER

FIELD OF THE INVENTION

The present invention relates to the field of microwave devices and more specifically to splitters or combiners of electromagnetic waves with orthogonal polarizations.

BACKGROUND OF THE INVENTION

One of the methods to increase a wireless communication system throughput is the usage of two orthogonal polarizations than can be done without significant sophistication of the transceiver. This enables a simultaneous transmission and/or receipt of two data flows, each flow being carried by orthogonally polarized electromagnetic waves. The key components of such a system are dual polarized antennas and orthomode transducers, which are devices used to distinguish appropriately polarized waves from the common dual-pol antenna port. Each of single-pol waves is guided to one or more orthomode transducers ports.

Traditionally, orthomode transducers are provided on hollow metallic waveguides, and more specifically on several waveguides of rectangular cross-section which support only one polarization, and one waveguide of a round or square cross-section, which supports two types of orthogonal waves. Usually, a round or square waveguide port is connected to the dual polarized antenna. One of such orthomode transducers is disclosed in U.S. Pat. No. 6,087,908 and presented herein in FIG. 1. The main drawbacks of such orthomode transducer are large dimensions, complexity and, consequently, high manufacturing cost since the high-precision milling or welding of several complex metal pieces is required. It leads to the fact that it is hard to integrate such waveguide orthomode transducer into the microwave front-end of the transceiver devices.

To overcome the abovementioned drawbacks of the orthomode transducer based on hollow metallic waveguides, planar orthomode transducers based on probes were recently introduced. In this case, separation of orthogonal polarizations is provided by orthogonal metal probes etched on a single or several printed circuit boards which are fixed across a round or square dual polarized waveguide. This waveguide is connected to the dual polarized antenna port. Similar orthomode transducer is disclosed in patent JPH11308004 and shown in FIG. 2. In such structure both of orthomode transducer output ports are provided as planar (usually 2 microstrip) transmission lines on the printed circuit board. Wherein probes are just extensions of these microstrip lines inside a waveguide.

Technology of printed circuit boards is developed rapidly in the last decade. The printed circuit boards process for low-loss substrates which have low dielectric losses in microwave frequency range has became much cheaper than manufacturing of hollow waveguide components and, thus, more profitable in mass-production. From the technical point of view, the usage of printed circuit boards instead of waveguides allows significantly decreasing device dimensions and simplifying its integration in the transceiver's radio frequency circuit.

However, the probe based orthomode transducer implemented on the printed circuit board has several other drawbacks. These are a relatively low isolation between orthogonally polarized channels, a narrow frequency band and the need of additional quarter-wave metal backshort for the input of dual polarized waveguide.

Alternatively, an orthomode transducer can be embodied by replacement of the dual polarized waveguide (with round or square cross-section) connecting antenna output and the orthomode transducer itself with the antenna element that can be either a separate dual polarized antenna or a primary radiator element that forms the required amplitude and phase distributions to illuminate the main antenna (e.g., a lens antenna or a dish reflector antenna).

Such approach is disclosed in patent CN104752841 and shown herein in FIG. 3. In this case, a primary radiator is a resonant cavity loop antenna (330) which is implemented in the top metallization layer of the printed circuit board. Besides this, due to the loop antenna of square form, it is possible to simultaneously excite the loop with both linear orthogonal polarizations. Substrate integrated waveguide sections (335, 336) are used as feeding lines for the loop antenna (330). The substrate integrated waveguide is a planar transmission line that is provided inside the printed circuit board in between two metallized layers by bounding the waveguide channel area with metallized via holes. To achieve a high isolation between two transducer's outputs, a via hole (334) is arranged in the center of the primary radiator. This via hole prevents resonant loop antenna excitation from the isolated orthogonal substrate integrated waveguide. In this design, the primary radiator forms the required amplitude and phase distributions for the overlying main antenna. The substrate integrated waveguides of orthogonal polarizations (335, 336) can be ended by transitions to microstrip lines to facilitate integration with a radio frequency transceiver. Wherein both the primary radiator and the transceiver can be implemented on the same printed circuit board.

But there are several technical drawbacks in the orthomode transducer described above and considered as the closest prior art of the present invention:

1. Lack of versatility. The usage of the primary antenna element together with the main antenna significantly decreases the variety of possible antenna designs which can be implemented together with the primary antenna element. In other words, the considered orthomode transducer does not have a commonly used dual polarized port such as, for example, a dual polarized metal waveguide. This prevents from using different antennas with the orthomode transducer and significantly limits its applications. Such approach cannot be implemented for very common horn antennas or integrated lens antennas which have waveguide feed radiator placed on the flat lens surface;

2. Narrow frequency band. As such, a resonant cavity slot antenna is a narrow conductive frame which starts to radiate at the tuning frequency that depends on the frame perimeter. That is why both the antenna and, consequently, the orthomode transducer have relatively narrow operational frequency range (4%) that has been confirmed by experimental data as presented in CN104752841;

3. Low isolation between orthogonal polarizations. An experimental orthogonal polarization isolation of the described orthomode transducer is only 22 . . . 23 dB in the operational frequency band (data also shown in CN104752841). For many wireless communication applications this isolation could be not enough;

4. High insertion loss. The considered orthomode transducer with the primary antenna element has relatively high insertion loss due to the narrow radiating slot of the resonant cavity loop frame. A narrow slot in the loop frame increases the surface current density and the electric field intensity in dielectric near to the slot. This increases the insertion loss level.

Thus, there is a need for a more universal orthomode transducer device which is applicable for connection to any dual polarized antennas with waveguide interface, that has wider passband, higher orthogonal polarization isolation, lower insertion losses and is simple and planar.

SUMMARY OF THE INVENTION

The above issues have been solved by a planar orthomode transducer comprising a substrate integrated resonator connected to two substrate integrated waveguides, wherein both the substrate integrated resonator and the substrate integrated waveguides are formed provided by a plurality of metallized via holes between two metallization layers of a printed circuit board, and wherein the planar orthomode transducer further comprises a dual polarized metal waveguide, and the substrate integrated resonator additionally comprises a slot aperture in one of the metallization layers, wherein the dual polarized metal waveguide is mounted on a surface of the printed circuit board in an area the slot aperture of the substrate integrated resonator, and the substrate integrated resonator is a resonator used for high-order orthogonal modes.

This enables, on the one hand, widening of the operating frequency band of the planar orthomode transducer, reducing of insertion losses, improvement of the polarization diversity, and, on the other hand, providing for a standard dual polarized output waveguide that serves to connect the planar orthomode transducer with antennas of various types.

Said technical effect is achieved by introducing a substrate integrated resonator that is placed in between two metallization layers of a printed circuit board and is formed by metallized via holes along the perimeter of the resonator. From two adjacent sides of the resonator, there are two substrate integrated waveguides that are connected to the substrate integrated resonator via windows in metallized via holes of the substrate integrated resonator. The resonator is the resonator of two nonfundamental (i.e., high-order) orthogonal modes of the electromagnetic field. Due to that, the resonator is excited by one of the substrate integrated waveguides, the other stays unexcited, thus there is high isolation between two orthomode transducer outputs.

There is a slot aperture of a special form in the substrate integrated resonator, represented by a slot in the top metallization layer of the printed circuit board. The excitation of the metal dual polarized waveguide is provided through this aperture. This waveguide is capable to transmit two orthogonally polarized electromagnetic waves simultaneously. Whereas each polarization corresponds to one of two nonfundamental orthogonal modes of the substrate integrated resonator. As a result, two modes in the substrate integrated resonator are excited by transmitting orthogonal waves to the planar orthomode transducer input through the dual polarized metal waveguide. Each mode excites only one of the substrate integrated output waveguides.

The widening of operating passband and the reduction of insertion losses of the planar orthomode transducer are provided by the absence of resonating elements (such as a slot loop) in the slot aperture of the substrate integrated resonator.

The improvement of the polarization diversity is provided by the use of the substrate integrated resonator of nonfundamental orthogonal modes in the structure of the planar orthomode transducer.

The planar orthomode transducer has a dual polarized metal waveguide as an input interface in its structure. This type of waveguides is a standard interface for variety of microwave devices and antennas. That makes the transducer more adapted for different applications.

In one embodiment of the present invention, the substrate integrated resonator and the substrate integrated waveguides are formed in the printed circuit board that has only one dielectric layer. In this embodiment it is possible to optimize thickness of this layer to decrease an insertion loss and to provide better impedance matching.

In another embodiment of the present invention, the substrate integrated resonator and the substrate integrated waveguides are formed provided in the multilayer printed circuit board. In this embodiment it is possible to form the resonator and the waveguides either in one dielectric layer of the printed circuit board (e.g., at the top layer) or in several layers of the board between any two metallization layers.

In a specific embodiment of the present invention, the substrate integrated resonator has one of the following shapes: square shape, round shape, cruciate shape, H-shape. This shape is formed by the plurality of metallized via holes in the printed circuit board. The shape of the resonator depends on the shape of the cross section of the dual polarized metal waveguide because in that case it is relatively simple to get good impedance matching in a wide frequency band.

In various specific embodiments of the present invention, the dual polarized metal waveguide has one of the following shapes: a square shape, a round shape, a cruciate shape, an H-shape. The variety of shapes of the planar orthomode transducer makes it universal and provides the possibility to connect the transducer to various antennas that have waveguide interface of different cross-section shapes.

In one embodiment of the present invention, the slot aperture of the substrate integrated resonator has one of the following shapes: a square shape, a round shape, a cruciate shape, an H-shape. In particular embodiments this shape is the same as a shape of the substrate integrated resonator.

In another embodiment of the present invention, the slot aperture of the substrate integrated resonator includes feeding probes. Usually such probes are projected to the slot aperture of the substrate integrated resonator. They are disposed at the top metallization layer of the printed circuit board and intended for additional impedance matching.

In other more specific embodiment of the present invention, the transducer further comprises metal ridges along the sidewalls of the dual polarized metal waveguide. Those ridges are aimed for impedance matching between the substrate integrated resonator and the dual polarized metal waveguide. In particular embodiment these metal ridges are formed along sidewalls and are smoothly tapered into the waveguide channel staring from the printed circuit board, i.e. wedge shaped.

In another embodiment of the present invention, the planar orthomode transducer has at least one additional metallized via hole between two metallization layers of the printed circuit board, this hole located inside the substrate integrated resonator. Such additional metallized via holes are aimed for tuning the structures of the orthogonal modes of the substrate integrated resonator in the areas close to the resonator feeding points to compensate for the associated discontinuities.

In a further embodiment of the presented invention, the substrate integrated resonator is connected to the substrate integrated waveguides through windows in the plurality of via holes forming substrate integrated resonator and additionally through the matching irises of the substrate integrated waveguides.

In another embodiment of the present invention, the outputs of the substrate integrated waveguide are connected to the transitions to the planar transmission line that have one of the following types: a microstrip transmission line, a strip transmission line, a coplanar transmission line, a differential transmission line. In particular embodiment, these transmission lines are connected to the contact pads of the integrated circuits of the radio frequency module of the transceiver.

In another particular embodiment of the present invention, the substrate integrated waveguides are connected to substrate integrated filters. In this case, filters are aimed for frequency duplexing of two differently polarized signals. In particular embodiment, these are frequency duplexing filters of received and transmitted signals.

In one embodiment of the present invention, the substrate integrated waveguides are connected to transitions to metal waveguides. This structure is used to connect the planar orthomode transducer with the outputs of receivers and transmitters having waveguide interface.

In another embodiment of the present invention, the planar orthomode transducer is a primary radiator of an aperture antenna. In this case, a signal is directly radiated from the dual polarized metal waveguide to the side of the aperture antenna.

In another embodiment of the present invention, the output of the dual polarized metal waveguide is connected to an antenna. In particular embodiments these can be different horn antennas, reflector antennas or integrated lens antennas.

BRIEF DESCRIPTION OF THE DRAWINGS

Details, features and advantages of the present invention follow from the description given further for the claimed technical embodiment and drawings that denote the following:

There are following features denoted in the figures: 1—a substrate integrated resonator; 2—substrate integrated waveguides; 3—a slot aperture of the substrate integrated resonator; 4—feeding probes; 5—metal ridges; 6—additional metallized via holes; 7—a matching irises of the substrate integrated waveguide; 8—windows in via holes forming the substrate integrated resonator; 9—a dual polarized metal waveguide; 10—a printed circuit board; 11—metallization layers; 12—dielectric layers.

DETAILED DESCRIPTION OF THE INVENTION

Figure 1:
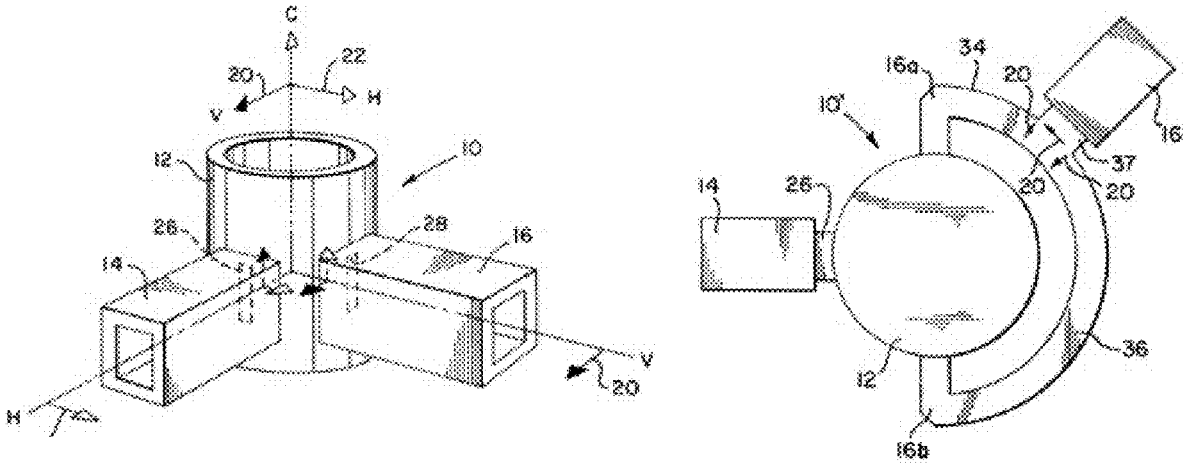
Fig. 1 (Prior art)
FIG. 1—a waveguide orthomode transducer (prior art)
Figure 2:
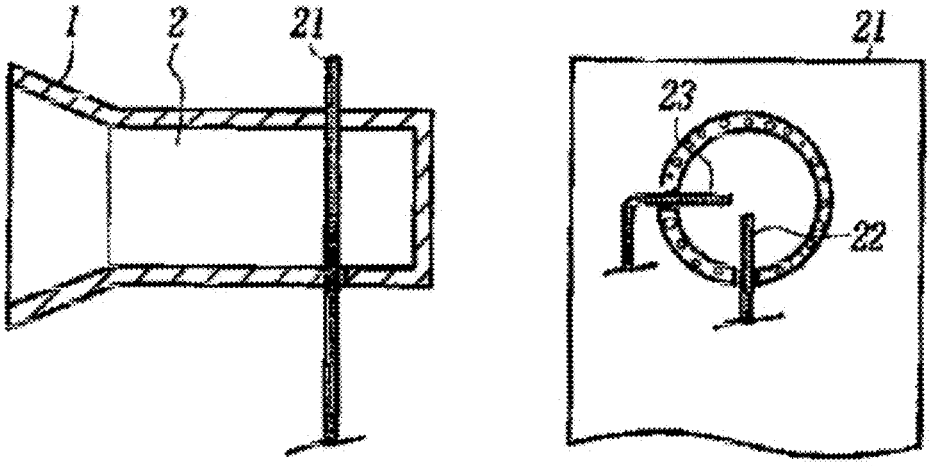
Fig. 2 (Prior art).
FIG. 2—a planar probe type orthomode transducer implemented on the printed circuit board (prior art)
Figure 3:
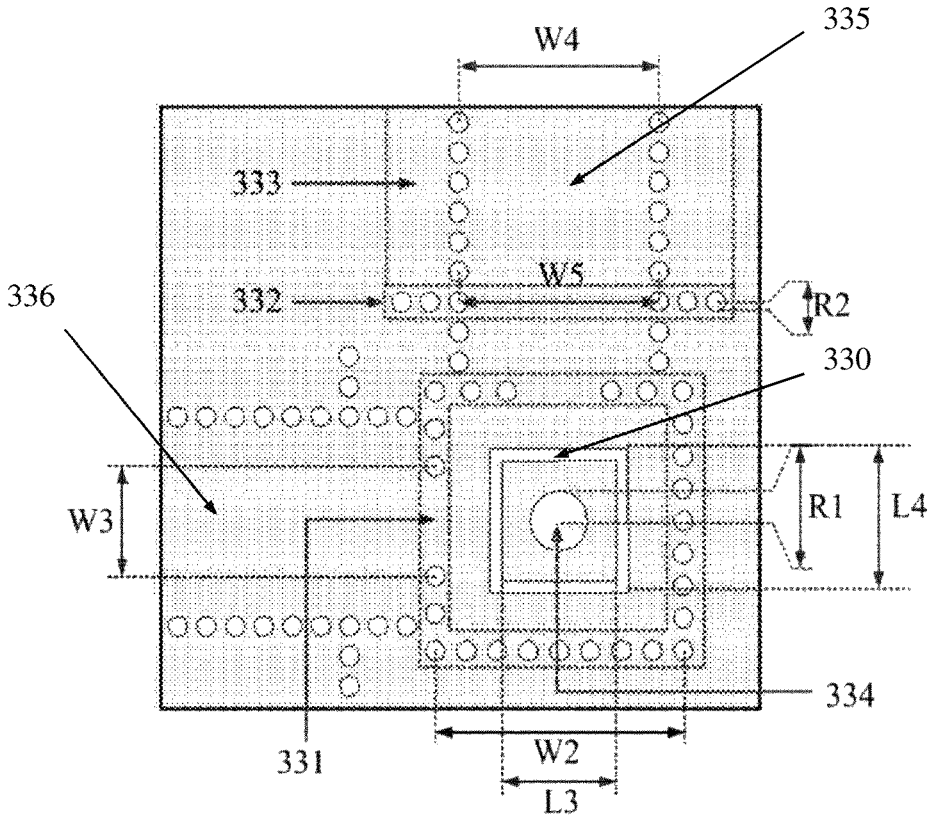
Fig. 3 (Prior art).
FIG. 3—a dual polarized radiator of a flat lens antenna (prior art)
Figure 4A:
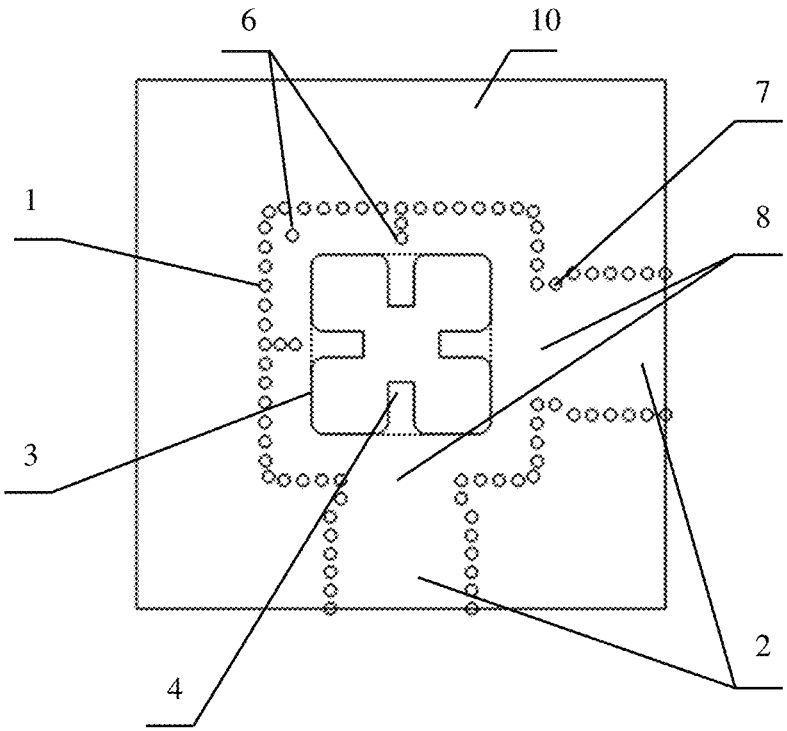
FIG. 4A—a topology of a printed circuit board of a planar orthomode transducer according to one embodiment of the present invention.
Figure 4B:
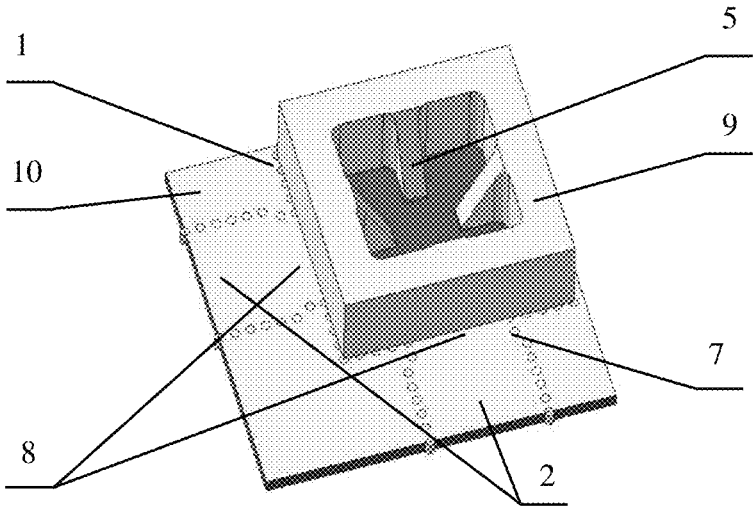
FIG. 4B—an appearance of a planar orthomode transducer according to one embodiment of the present invention.
Figure 4C:
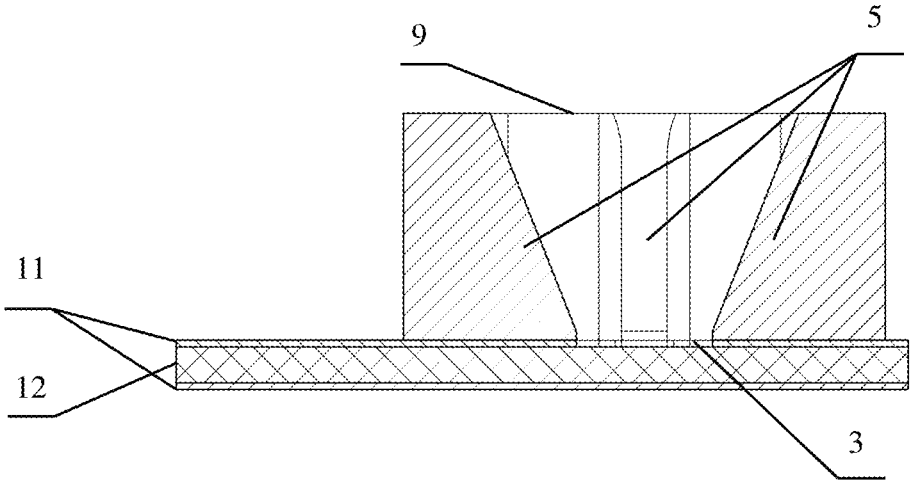
FIG. 4C—cross-section of a planar orthomode transducer comprising a single dielectric layer.
Figure 4D:
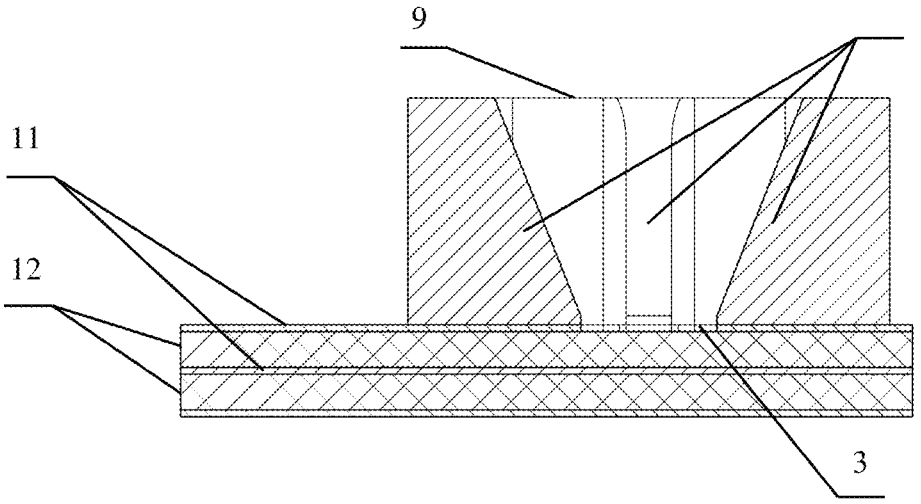
FIG. 4D—cross-section of a planar orthomode transducer comprising several dielectric layers.
Figure 5:
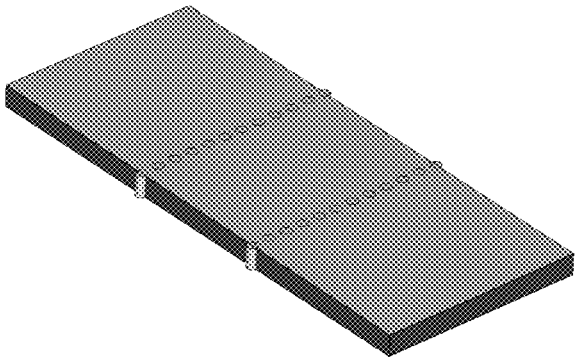
Fig. 5 (Prior art)
FIG. 5—substrate integrated waveguide implemented in the printed circuit board (prior art)

One embodiment of the present invention of a planar orthomode transducer is shown in FIG. 4. It comprises a substrate integrated resonator (1) with two substrate integrated waveguides (2) connected to the substrate integrated resonator (1), wherein the substrate integrated resonator (1) and the substrate integrated waveguides (2) are formed by a plurality of metallized via holes between two metallization layers (11) of a printed circuit board (10). The substrate integrated waveguide (2) is shown in FIG. 5. Metallized via holes connecting bottom and top metallization layers (11) of the printed circuit board (10) form sidewalls of the substrate integrated waveguides (2). Top and bottom metallization layers (11) of the printed circuit board (10) form top and bottom walls of the substrate integrated waveguides (2). Thus, substrate integrated waveguides (2) have dielectric filling that consists of the printed circuit board (10) substrate material. Operating principle of the substrate integrated waveguides (2) and their parameters fully comply with the dielectric filled metal waveguide of the same dimensions.

A dual polarized metal waveguide (9) is mounted on a surface of the printed circuit board (10). Walls of the dual polarized metal waveguide that is disposed on the printed circuit board (10) contact the top metallization layer (11) of the printed circuit board (10). The aperture of the dual polarized metal waveguide covers a slot aperture of the substrate integrated resonator (3) that is formed in the top metallization layer (11) of the printed circuit board (10) and has the same square shape as the metal waveguide cross-section form. The substrate integrated waveguides (2) are connected to the substrate integrated resonator (1) through windows in via holes of the substrate integrated resonator (8) and matching irises of the substrate integrated waveguides (7). The substrate integrated waveguides (2) are disposed at two adjacent sides of the substrate integrated resonator (1), orthogonally to each other. Whereas they have such dimensions that only fundamental electromagnetic mode exists in that waveguides (fundamental mode waveguides) in the operating frequency band of the planar orthomode transducer.

Figure 6:
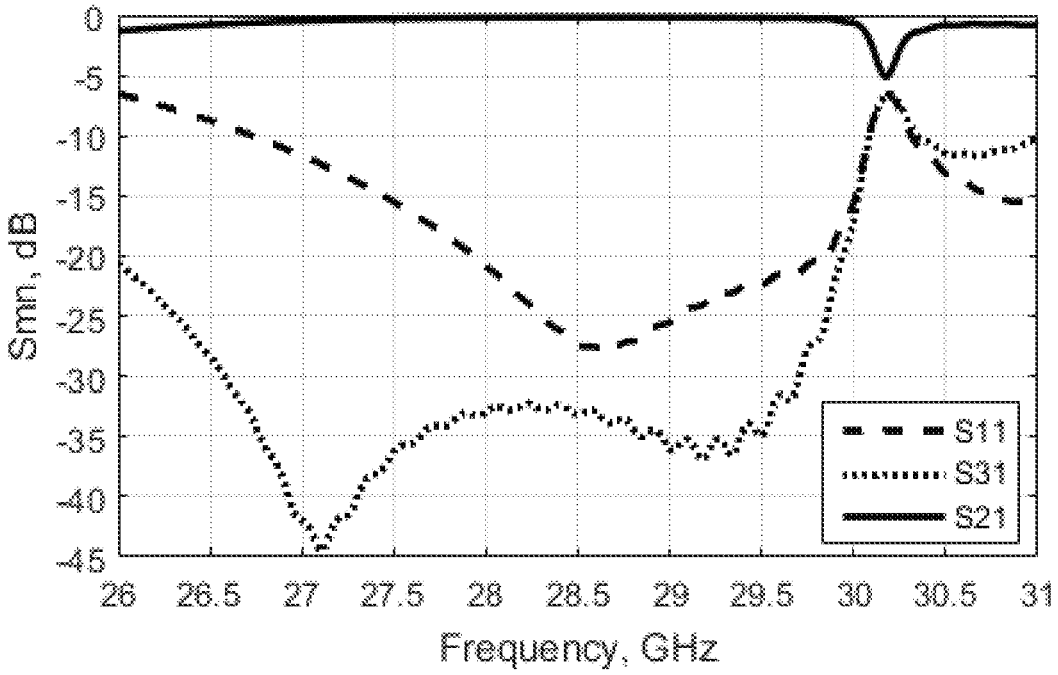
FIG. 6—simulated response of a planar orthomode transducer according to one embodiment of the present invention.

In the frequency band of the planar orthogonal transducer, dimensions of the substrate integrated resonator (1) allow to provide the substrate integrated resonator (1) with the higher order of the electromagnetic modes. They are nonfundamental orthogonal modes $TEM_{21}$ and $TEM_{12}$. FIG. 6 shows distributions of the electric field of these nonfundamental orthogonal modes. The electromagnetic field of one of the orthogonal nonfundamental mode is maximum in the junction point of the substrate integrated resonator (1) and the first of the substrate integrated waveguides (2) and minimum in the junction point of the substrate integrated resonator (1) and the second substrate integrated waveguide (2); electromagnetic field of the orthogonal nonfundamental mode that is orthogonal to the first mode, vice a versa, has its maximum in the junction point of the substrate integrated resonator (1) and the second substrate integrated waveguide (2) and minimum in the junction point of the substrate integrated resonator (1) and the first of the substrate integrated waveguides (2). In particular case, the width of the sidewall of the substrate integrated resonator (1) of nonfundamental mode is selected to be equal to the wavelength of the resonating signal, and the width of the substrate integrated waveguides of fundamental mode is equal to the half of the wavelength.

The printed circuit board (10) of the planar orthomode transducer can comprise one or more dielectric layers (12). In order to change a thickness of the dielectric layer (12) or to change the dielectric material of the printed circuit board (10) the substrate integrated resonator (1) and the substrate integrated waveguides (2) can be provided in a single dielectric layer (12) or in several dielectric layers (12) of the printed circuit board (10). Such flexibility allows to use the planar orthomode transducer together with any other planar devices, including a full featured transceiver module that usually requires several layers of the microwave printed circuit board.

Shapes of the substrate integrated resonator (1) and the dual polarized metal waveguide (9) can be different: square, round, cruciate, H-shape or any other shape that allows to transmit or excite two orthogonal modes. Thus, for the dual polarized metal waveguide (9) it is the main fundamental modes $TEM_{010}$ and $TEM_{100}$, and for the substrate integrated resonator (1) it is the nonfundamental high-order modes $TEM_{21}$ and $TEM_{12}$. Shapes of the substrate integrated resonator (1) and the dual polarized metal waveguide (9) can be different or the same.

To match impedances between the dual polarized waveguide (9) and the substrate integrated resonator (1) of the planar orthomode transducer according to FIG. 4, metal ridges (5) along the sidewalls of the dual polarized metal waveguide (9) are used. These metal ridges (5) function as additional impedance transformers in the wide frequency band. To transform the impedance smoothly, the metal ridges (5) can be smoothly tapered into the waveguide channel (wedge-shaped) starting from the slot aperture of the substrate integrated resonator (3) to the dual polarized metal waveguide (9).

Shapes of the slot aperture of the substrate integrated resonator (3) can be also different. Moreover, to achieve effective matching between the substrate integrated resonator (1) and the dual polarized metal waveguide (9) the slot aperture of the substrate integrated resonator (3) can comprise feeding probes (4), especially if metal ridges (5) are used at the same time.

The planar orthomode transducer can comprise additional metalized via holes (6), which align the structure of the electromagnetic modes of the substrate integrated resonator (1) and increase the operational frequency band of the planar orthomode transducer. These additional metallized via holes (6) are provided inside the perimeter of the substrate integrated resonator (1) but outside the area of the slot aperture of the substrate integrated resonator (3) and opposite the junction points of the substrate integrated waveguides (2). Junction points brings distortions to the structure of the fields of the modes which are excited by the substrate integrated resonator (1). FIG. 4 shows the planar orthomode transducer with the additional metallized via holes (6) added in the corner of the substrate integrated resonator opposite to both substrate integrated waveguides (2).

There are no additional radiating elements and there is no need for additional antenna mounting elements because of using the dual polarized metal waveguide (9). It allows to provide the transducer in smaller dimensions in comparison with the prior art. Besides, the possibility to make shapes of the dual polarized metal waveguide (9) different allows the device to be adapted for different applications.

The additional metallized via holes (6) as well as matching irises of the substrate integrated waveguide (7) at the junction points of the substrate integrated waveguide and the substrate integrated resonator (1) allow to increase the polarization diversity to 30 dB and to increase the frequency band. FIG. 6 shows the S-parameters simulation results of the planar orthomode transducer according to the embodiment of the present invention. The «S21» curve corresponds to the transmission coefficient calculated between the dual polarized metal waveguide (9) and one of the substrate integrated waveguides (2), where only one of linear polarizations excites at the input of the dual polarized metal waveguide (9). This polarization gets into the mentioned substrate integrated waveguide (2) with small insertion loss. The «S31» curve corresponds to the transmission coefficient calculated between the dual polarized metal waveguide (9) and the other substrate integrated waveguide (2), that is isolated in this case. When orthogonal polarization excites at the input of the dual polarized metal waveguide (9), these curves will be reversed. The «S11» curve stays unchanged and corresponds to the coefficient of the input reflection of the planar orthomode transducer. FIG. 6 shows that the input reflection coefficient of the planar orthomode transducer does not exceed −10 dB, polarization discrimination is not less than 30 dB, and insertion loss is not higher than 0.5 dB in 26.8 . . . 29.7 GHz frequency band.

The disclosed planar orthomode transducer does not contain narrow radiating slots that would have high concentration of the conductive currents and high electric field intensity in the dielectric layer (12) of the printed circuit board (10) near the slot. Besides, the area of the slot aperture of the substrate integrated resonator (3) is larger in comparison with the prior art. Considering the above the level of the insertion losses which are brought by conductive currents is lower, that means that the insertion losses of the planar orthomode transducer is lower in the operating frequency band.

The planar orthomode transducer can be used as a radiating element for dielectric or metal aperture antennas. An output of the dual polarized metal waveguide (9) can illuminate a dielectric lens or another printed circuit board comprising reradiating elements. Thus, the planar orthomode transducer can function as a primary antenna element. Besides, the output of the planar orthomode transducer can be directly connected to an antenna that has waveguide interface, e.g. a horn antenna.

The outputs of the substrate integrated waveguides can comprise transitions from the substrate integrated waveguides (2) to microstrip, coplanar, strip, differential lines to match the planar orthomode transducer and the radio frequency transceiver module.

The outputs of the substrate integrated waveguides can be directly connected to the contact pads of the radio frequency transceiver module, the pad being provided on the same printed circuit board (10) as the planar orthomode transducer by the transitions mentioned above. Thus, the planar orthomode transducer and the radio frequency transceiver module can be implemented on the common printed circuit board (10).

The substrate integrated waveguides (2) can be connected to substrate integrated filters that comprise the substrate integrated resonators and are formed by two metallization layers (11) of the printed circuit board (10) and metallized via holes. Thus, the printed circuit board (10) of the planar orthomode transducer can comprise an integrated element that provides frequency filtering at the radio frequency module of the transceiver.

The substrate integrated waveguides (2) can be connected to the transitions from the substrate integrated waveguides to the metal waveguides. Thus, the planar orthomode transducer can be connected to the waveguide interface devices, e.g. a standard measuring equipment.

Figure 7:
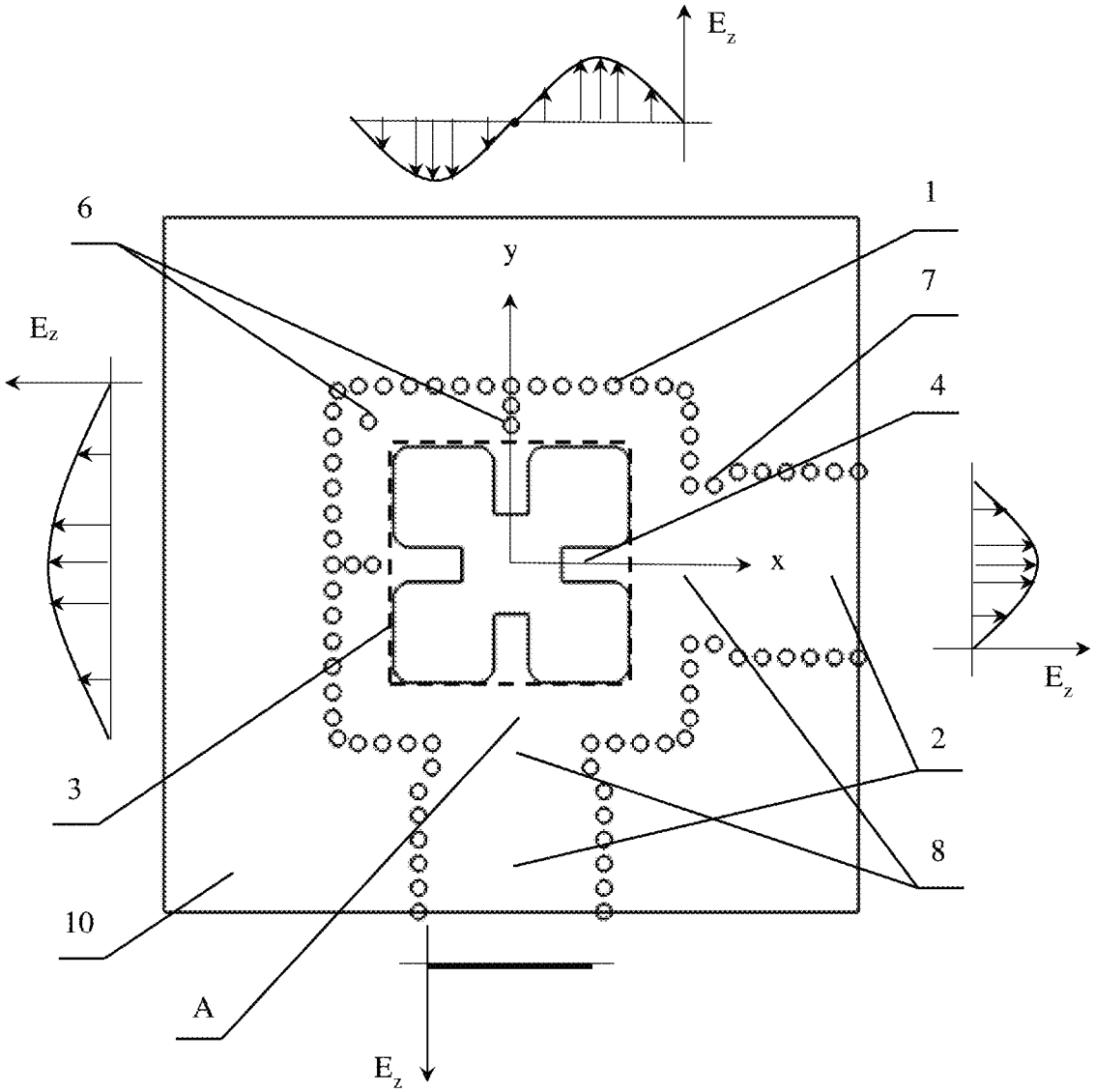
FIG. 7—operating principle of a planar orthomode transducer according to one embodiment of the present invention.

The present planar orthomode transducer operates in the following way. The fundamental (main) modes $TEM_{100}$ and $TEM_{010}$ of the dual polarized metal waveguide (9) excite nonfundamental orthogonal modes $TEM_{21}$ and $TEM_{12}$ inside the substrate integrated resonator (1). When the fundamental mode $TEM_{100}$ of the dual polarized metal waveguide (9) propagates and its electric field is polarized along X axis then the nonfundamental mode is excited in the substrate integrated resonator (1). FIG. 7 shows the electric field distribution $E_z$ along X and Y axes of this nonfundamental mode. Whereas the maximum of the distribution of the electric field of the nonfundamental mode of the substrate integrated resonator (1) coincides with the maximum of the nonfundamental mode of one of the substrate integrated waveguides (2) oriented along X axis, i.e. disposed according to the drawing shown in FIG. 7 to the right of the substrate integrated resonator (1). Whereas, the maximum of the fundamental mode of the other substrate integrated waveguide (2) oriented along Y axis matches with the zero of the electric field of the nonfundamental mode of the substrate integrated resonator (1) (point A). Thus, the polarization of the fundamental mode of the dual polarized metal waveguide (9) excites only one port of the substrate integrated waveguides (2). At the same time, the port of the other substrate integrated waveguide (2) stays isolated. When the polarization of the fundamental mode of the dual polarized metal waveguide (9) is changed to the orthogonal, the distribution of the electromagnetic field of the nonfundamental mode ($TEM_{21}$) of the substrate integrated resonator (1) «rotates» by 90 degrees and forms the orthogonal nonfundamental mode ($TEM_{12}$) and then the port of the first substrate integrated waveguide (2) turns up isolated. Signals of both polarizations propagates along the dual polarized metal waveguide simultaneously, but each of them is transmitted to the only one substrate integrated waveguide (2). Thus, the present orthomode transducer provides effective polarization separation.

The present invention is not limited by the specific embodiments, that are mentioned in the description for illustration and covers whole possible embodiments and alternatives that are included in the present invention by the claims.

The invention claimed is:

1. A planar orthomode transducer comprising a substrate integrated resonator and two substrate integrated waveguides connected to the substrate integrated resonator, wherein both the substrate integrated resonator and the substrate integrated waveguides are formed by a plurality of metallized via holes between two metallization layers of a printed circuit board, wherein the planar orthomode transducer further comprises a dual polarized metal waveguide, while the substrate integrated resonator further comprises a slot aperture in one of the two metallization layers, wherein the dual polarized metal waveguide is mounted on a surface of the printed circuit board in an area of the slot aperture of the substrate integrated resonator, and the substrate integrated resonator is a nonfundamental orthogonal mode resonator.

2. The planar orthomode transducer according to claim 1, wherein the substrate integrated resonator and the two substrate integrated waveguides connected to the substrate integrated resonator are disposed on the printed circuit board with a single dielectric layer.

3. The planar orthomode transducer according to claim 1, wherein the substrate integrated resonator and the two substrate integrated waveguides connected to the substrate integrated resonator are disposed on the printed circuit board with several dielectric layers.

4. The planar orthomode transducer according to claim 1, wherein the substrate integrated resonator has one of the following shapes: a square shape, a round shape, a cruciate shape, an H-shape.

5. The planar orthomode transducer according to claim 1, wherein the dual polarized metal waveguide has one of the following shapes: a square shape, a round shape, a cruciate shape, an H-shape.

6. The planar orthomode transducer according to claim 1, wherein the slot aperture of the substrate integrated resonator has one of the following shapes: a square shape, a round shape, a cruciate shape, an H-shape.

7. The planar orthomode transducer according to claim 1, wherein the slot aperture of the substrate integrated resonator comprises conducting probes.

8. The planar orthomode transducer according to claim 1, wherein the dual polarized metal waveguide further comprises metal ridges along its sidewalls.

9. The planar orthomode transducer according to claim 8, wherein the metal ridges along the sidewalls of the dual polarized metal waveguide are smoothly tapered into a waveguide channel starting from the printed circuit board.

10. The planar orthomode transducer according to claim 1, wherein it the printed circuit board comprises at least one additional metallized via hole between the two metallization layers inside the substrate integrated resonator.

11. The planar orthomode transducer according to claim 1, wherein the substrate integrated resonator is connected to the substrate integrated waveguides via matching irises of the substrate integrated waveguides.

12. The planar orthomode transducer according to claim 1, wherein outputs of the substrate integrated waveguides are connected to transitions to a planar transmission line that is one of the following types: a microstrip transmission line, a strip transmission line, a coplanar transmission line, a differential transmission line.

13. The planar orthomode transducer according to claim 1, wherein transmission lines are connected to contact pads of a radio frequency module of a transceiver.

14. The planar orthomode transducer according to claim 1, wherein the substrate integrated waveguides are connected to substrate integrated filters.

15. The planar orthomode transducer according to claim 1, wherein the substrate integrated waveguides are connected to transitions to metal waveguides.

16. The planar orthomode transducer according to claim 1, wherein the planar orthomode transducer is a primary radiator of aperture antennas.

17. The planar orthomode transducer according to claim 1, wherein the dual polarized metal waveguide is connected to an antenna.

* * * * *